US011371716B2

(12) United States Patent
Camañes Vera et al.

(10) Patent No.: US 11,371,716 B2
(45) Date of Patent: Jun. 28, 2022

(54) HOB APPARATUS

(71) Applicant: BSH Hausgeräte GmbH, Munich (DE)

(72) Inventors: Victor Camañes Vera, Saragossa (ES); Jesús Ceamanos Gaya, Saragossa (ES); Clara Fuertes Pinol, Saragossa (ES); Patricia Gomez Bachiller, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 938 days.

(21) Appl. No.: 15/778,652

(22) PCT Filed: Nov. 22, 2016

(86) PCT No.: PCT/IB2016/057031
§ 371 (c)(1),
(2) Date: May 24, 2018

(87) PCT Pub. No.: WO2017/093850
PCT Pub. Date: Jun. 8, 2017

(65) Prior Publication Data

US 2018/0347823 A1 Dec. 6, 2018

(30) Foreign Application Priority Data

Dec. 4, 2015 (ES) ..... ES201531773

(51) Int. Cl.
*F24C 15/10* (2006.01)
*F24C 7/08* (2006.01)
*H05B 6/12* (2006.01)

(52) U.S. Cl.
CPC ..... *F24C 15/102* (2013.01); *F24C 7/083* (2013.01); *H05B 6/1218* (2013.01); *H05B 2213/03* (2013.01)

(58) Field of Classification Search
CPC ..... F24C 15/102; F24C 7/083; F24C 7/082; H05B 2213/03; H05B 6/1218
See application file for complete search history.

(56) References Cited

U.S. PATENT DOCUMENTS 8,389,912 B2 3/2013 Niiyama et al.
9,084,295 B2 7/2015 Sadakata et al.
10,314,428 B2 * 6/2019 Millett ..... H05B 1/0202
(Continued)

FOREIGN PATENT DOCUMENTS

DE 4405610 A1 8/1995
DE 102012205105 A1 10/2012
(Continued)

OTHER PUBLICATIONS

International Search Report PCT/IB2016/057031 dated Feb. 8, 2017.
National Search Report ES 201531773 dated Feb. 22, 2016.

*Primary Examiner* — Dana Ross
*Assistant Examiner* — James F Sims, III
(74) *Attorney, Agent, or Firm* — Michael E. Tschupp; Andre Pallapies; Brandon G. Braun

(57) ABSTRACT

A hob apparatus includes a heating region for placement and heating of a cooking container. A dynamic display unit provides an identification of the heating region in an operating mode, and a control unit selects an identifying property of the identification of the heating region in the operating mode, depending on an operating parameter.

23 Claims, 4 Drawing Sheets

(56) References Cited

U.S. PATENT DOCUMENTS

| | | | |
|---|---|---|---|
| 2007/0262072 | A1 | 11/2007 | Schilling |
| 2011/0011851 | A1 | 1/2011 | Kataoka. et al. |

FOREIGN PATENT DOCUMENTS

| | | | |
|---|---|---|---|
| EP | 2469973 | A1 | 6/2012 |
| JP | 2014116088 | A | 6/2014 |
| WO | 2014024459 | A1 | 2/2014 |

* cited by examiner

HOB APPARATUS

CROSS-REFERENCES TO RELATED APPLICATIONS

This application is the U.S. National Stage of International Application No. PCT/IB2016/057031, filed Nov. 22, 2016, which designated the United States and has been published as International Publication No. WO 2017/093850 A1 and which claims the priority of Spanish Patent Application, Serial No. P201531773, filed Dec. 4, 2015, pursuant to 35 U.S.C. 119(a)-(d).

BACKGROUND OF THE INVENTION

The invention relates to a hob apparatus as claimed in the preamble of claim 1.

A hob apparatus having a heating region and having a display unit which comprises just one identifying property is already disclosed in the European patent application EP 2 252 130 A1. In an operating mode in which a cooking container is placed on the heating region for heating purposes, the display unit identifies the heating region by means of an identification depending on an activation by a control unit. The control unit in this case keeps the identifying property of the identification of the heating region constant in the operating mode. The identifying property is independent of an operating parameter.

BRIEF SUMMARY OF THE INVENTION

The object of the invention is, in particular, to provide a generic apparatus with improved properties with regard to a high level of convenience. The object is achieved according to the invention by the features of claim 1, whilst advantageous embodiments and developments of the invention may be derived from the subclaims.

The invention is based on a hob apparatus, in particular an induction hob apparatus, having at least one heating region on which at least one cooking container can be placed for heating purposes, and comprising a dynamic display unit which is provided for identifying the heating region in at least one operating mode.

It is proposed that the hob apparatus comprises a control unit which is provided for selecting at least one identifying property of the identification of the heating region, in particular the aforementioned heating region, on which in particular at least one cooking container is able to be placed for heating purposes, in the operating mode, depending on at least one operating parameter. "Hob apparatus" is intended to be understood, in particular, as at least one part, in particular a subassembly, of a hob, in particular of an induction hob. In particular, the hob apparatus may also comprise the entire hob, in particular the entire induction hob. "Heating region" is intended to be understood, in particular, as an advantageously two-dimensional region which is provided for placing a cooking container thereon and/or for positioning food to be cooked thereon, in particular in order to warm the cooking container placed thereon and/or the food to be cooked positioned thereon. In an installed position the heating region is advantageously delimited downwardly from a hob plate, in particular in a direction of gravity. The hob apparatus comprises, in particular, at least two, in particular at least three, advantageously at least four, particularly advantageously at least five, preferably at least seven, and particularly preferably a plurality of heating units which are provided, in particular, to supply in at least one operating state energy to the heating region required for warming a cooking container placed thereon and/or food to be heated placed thereon. The heating units could be arranged, for example, in the form of a matrix and/or in the form of a conventional hob, in particular in the form of individual heating units. The heating region, in particular a size of the heating region and/or a shape of the heating region, is defined in particular by an arrangement and/or size of the heating units. In particular, the heating region has an at least substantially constant size and/or shape which, in particular, is independent of a size of a cooking container and/or of a shape of a cooking container. The heating region, in particular a size of the heating region and/or a shape of the heating region, is in particular independent of a size of a cooking container. For example, in particular in the case of a cooking container and/or food to be cooked filling and/or covering the entire heating region, the heating region, in particular a size of the heating region and/or a shape of the heating region, could be identical to a cooking container, in particular to a size of a cooking container and/or to a shape of a cooking container and/or to a cooking container diameter. Advantageously, the heating region is larger than a cooking container in particular than a cooking container diameter. The heating region, in particular, is configured differently from a heating zone. "Hob plate" is intended to be understood, in particular, as an element which is provided in an installed position to carry a cooking container placed on the heating region and/or food to be cooked positioned thereon. The hob plate consists, in particular, at least to a large part of glass and/or glass ceramics. "At least to a large part" is intended to be understood, in particular, as a proportion of at least 70%, in particular at least 80%, advantageously at least 90% and preferably at least 95%. "Display unit" is intended to be understood, in particular, as a unit which is provided to provide to an operator visually, and for example also acoustically and/or haptically, the identification of the heating region and, in particular, additionally at least one display parameter. The display parameter could, for example, be information and/or time details and/or an operating prompt and/or an action prompt and/or a selection. The display unit advantageously comprises at least one display element which advantageously is an LED. Advantageously, in particular when observing a projection on a plane oriented, in particular, parallel to the hob plate, the display unit extends over a proportion of at least 20%, in particular at least 40%, advantageously at least 50%, particularly advantageously at least 70%, preferably at least 80% and particularly preferably at least 90% of a transverse extension of the heating region and/or a longitudinal extension of the heating region. A surface which is at least partially enclosed by the display unit, in particular, adopts a value of at least 20%, in particular at least 40%, advantageously at least 50%, particularly advantageously at least 70%, preferably at least 80% and particularly preferably at least 90% of the extension of a surface area of the heating region. The display unit differs, in particular, from a display, in particular an LCD display, and advantageously additionally from a liquid crystal display. A "longitudinal extension" of an object is intended to be understood, in particular, as the extension of the object in a longitudinal direction of extension of the object. "Longitudinal direction of extension" of an object, is intended to be understood, in particular, as a direction which is oriented parallel to a longest side of a smallest imaginary geometric cuboid which encloses the object fully. "Extension" of an object is intended to be understood, in particular, as a maximum spacing between two points of a vertical projection of the object on a plane. "Transverse extension" of an object is intended to be understood, in particular, as the extension of the object in a transverse direction of extension oriented perpendicular to the longitudinal direction of extension of the object. "Dynamic" display unit is intended to be understood, in particular, as a display unit which is advantageously provided for intentionally altering at least one identifying property, in particular, depending on an activation of the display unit by the control unit. The intentional alteration of an identifying property differs, in particular, from an alteration of the identifying property which occurs due to a temperature effect and/or by abrasion and/or by wear. "Control unit" is intended to be understood, in particular, as an electronic unit which preferably is at least partially integrated in a control unit and/or regulating unit of a hob, in particular an induction hob, and which is preferably provided to control and/or regulate at least the heating region. Preferably, the control unit comprises a computation unit and, in particular additionally to the computation unit, a memory unit with a control program and/or regulating program which is stored therein and which is provided to be implemented by the computation unit. In particular in the case of a cooking container placed on the heating region, the control unit is provided to form from at least one heating unit at least partially defining the heating region at least one heating zone for heating the cooking container placed thereon. The control unit is provided, in particular, for activating the display unit. Advantageously, in the operating mode the control unit is provided for identifying the heating region continuously, in particular during the entire operating mode, and advantageously continuously visible to an operator. In particular, in the operating mode the control unit is provided for identifying continuously the heating region independently of a cooking container placed thereon and/or food to be cooked positioned thereon and/or carrying out a heating process. "Continuously" is intended to be understood, in particular, as continuously and/or constantly and/or preventing an unidentified timespan, wherein in particular an alteration to a wavelength and/or an intensity and/or a color and/or a frequency is possible. In particular, the display unit could be provided, in particular, for altering a wavelength and/or an intensity and/or a color and/or a frequency. In particular, the operating mode is independent of a cooking container. In particular, the operating mode is independent of placing a cooking container in the heating region. In particular, the operating mode is independent of a removal of a cooking container from the heating region. For example, the operating mode could be set and/or selected and/or activated and/or deactivated by an operating input by means of an operator interface. Alternatively or additionally, the operating mode could be stored, in particular, in a memory unit of the control unit. For example, it is possible for the operating mode to be able to be implemented by the control unit, in particular automatically. "Identifying property" is intended to be understood, in particular, as a property of an actual identification. In the operating mode the identifying property is, in particular, continuously visible to an operator. The identifying property could, in particular, be an illuminating property. In particular the identification could be a light. For example, the hob apparatus could have, in particular in addition to the dynamic display unit, a static display unit which could be provided for an identification of the heating region. The static display unit could, for example, be an identification of the heating region incorporated in a surface of the hob plate. "Provided" is intended to be understood, in particular, as specifically programmed, designed and/or equipped. An object being provided for a specific function is intended to be understood, in particular, as the object fulfilling and/or implementing this specific function in at least one use state and/or operating state.

By means of the embodiment according to the invention, in particular, a high level of convenience may be achieved. In particular, an improved operability may be achieved and/or at least one piece of information relative to an operating parameter of the hob may be transmitted to an operator. In particular, by the identification of the display unit a visual and/or intuitive identification of operating properties and/or operating parameters may be possible, whereby in particular an improved communication to an operator may be achieved. In particular, a possible positioning of a cooking container may be identified cost-effectively, such as for example by dispensing with an LCD display and/or a liquid crystal display, and/or in a convenient manner.

It is further proposed that in the operating mode the control unit is provided to keep a size of the identification, in particular of the heating region and advantageously each heating region, at least substantially constant. In particular, in the operating mode the control unit is provided to keep a surface and/or a shape of the identification, in particular of the heating region and advantageously additionally each heating region, at least substantially constant. As a result, in particular, an optimal identification of the heating region may be provided. In particular, a certainty about the size of the heating region and thus, in particular, safe operability may be communicated to an operator.

Additionally, it is proposed that in the operating mode the control unit is provided to alter the identifying property depending on an alteration of the operating parameter. In particular, in the operating mode the control unit is provided to adapt the identifying property to a property of the operating parameter. For example, in the operating mode the control unit could be provided to alter the identifying property depending on an alteration of a state of the operating parameter, wherein the operating parameter, in particular, could be a cooking state. Alternatively or additionally, in the operating mode the control unit could be provided to alter the identifying property depending on an alteration of a value of the operating parameter, wherein the operating parameter, in particular, could be a heating parameter. As a result, in particular, a high level of flexibility may be achieved. Particularly advantageously, information may be provided to an operator about an alteration of the operating parameter.

For example, the identifying property could be a color and/or a frequency and/or wavelength. Preferably, the identifying property is an intensity of the identification of the heating region. Advantageously, the control unit is provided to alter the intensity of the identification of the heating region monotonously, in particular rising monotonously, with a value of the operating parameter altering monotonously, in particular rising monotonously. An "intensity" of an identification is intended to be understood, in particular, as a radiation intensity and/or light intensity and/or a brightness and/or a saturation, in particular a color saturation. For example, the control unit could be additionally provided, in particular, to alter the intensity of the identification of the heating region depending on a full use of the heating units defining the heating region. The control unit could, for example, be provided for altering monotonously the intensity of the identification of the heating region to a monotonously altering value of the full use of the heating units defining the heating region. The identifying property is advantageously an illuminating property. Advantageously, the identification is a light. As a result, an operator may, in particular, verify in a simple and/or convenient manner a heating parameter used and/or set.

In the case of an at least substantially constant operating parameter, the control unit is advantageously provided to keep the intensity of the identification of the heating region at least substantially constant. Preferably, in the operating mode the control unit is provided to display an operating parameter which alters in at least one direction oriented parallel to a hob plate, by means of the identification of the heating region, in particular by means of an alteration of the identifying property in the direction. As a result, in particular, an intuitive identification of the heating parameter may be possible. In particular, at least one piece of information relative to an operating state and/or an operating parameter may be transmitted to an operator, such as for example information relative to a residual heat and/or relative to a heating parameter and/or relative to activated partial regions of the heating region and/or relative to heating zones of the heating region.

For example, the direction could be a transverse direction and the control unit, in particular, could be provided to display heating parameters altering in the transverse direction by means of the identification. Preferably, the direction is a depth direction. The depth direction is, in particular, oriented from a region of the heating region facing an operator into a region of the heating region remote from an operator and, in particular, parallel to a main extension plane of the hob plate. In particular, the transverse direction is oriented at least substantially perpendicular to the depth direction and, in particular, parallel to a main extension plane of the hob plate. In the case of an operating parameter altering in the depth direction, in particular the control unit is provided to select in the region of the heating region facing an operator a different, in particular a greater and/or lower, intensity of the identification of the heating region than in the region of the heating region remote from an operator. A "main extension plane" of an object is intended to be understood, in particular, as a plane which is parallel to a largest side surface of a smallest imaginary geometric cuboid which encloses the object fully and, in particular, extends through the central point of the cuboid. As a result, in particular, a high level of convenience for an operator may be possible.

The operating parameter could, for example, be a cooking state and/or an input variable which, in particular, could be predetermined and/or input and/or set by an operator by a operating input by means of an operator interface. Preferably, the operating parameter is a heating parameter. For example, the heating parameter could be a heat output and/or a heat output density and/or a heat output stage and/or a temperature. In the case of a heating parameter which is a heat output and/or a heat output density and/or a heat output stage, in particular, the operating mode could be an operating mode denoted as "power move" in which in particular an alteration of the heating parameter may be undertaken by a displacement of the cooking container in the heating region, in particular in the direction. In the case of a heating parameter which is a temperature, in particular, the operating mode could be an operating mode denoted as "temperature move" in which in particular an alteration to the heating parameter by a displacement of the cooking container in the heating region may be undertaken, in particular in the direction. As a result, in particular, the possibility of optimal identification of an operating mode denoted as "power move" and/or as "temperature move" may be achieved.

Moreover, it is proposed that the heating region comprises at least one combined heating zone. In particular, the heating region, advantageously the combined heating zone, is defined by at least two, in particular at least three, advantageously at least four, particularly advantageously at least five, preferably at least seven and particularly preferably a plurality of heating units. For example, the heating region could consist of the combined heating zone and, in particular, be defined by the heating units defining the combined heating zone. The heating region, in addition to the heating units defining the combined heating zone, is advantageously defined by at least one further heating unit. A heating zone is, in particular, a region which, in particular, is defined by at least one heating unit which supplies energy to the heating zone in at least one heating operating state, in particular in the form of heat, advantageously in the form of an electromagnetic alternating field. In particular, an electromagnetic alternating field passes through and/or penetrates the heating zone, in particular a surface of the heating zone, in the heating operating state. The heating zone, in particular a size of the heating zone and/or shape of the heating zone, is in particular defined by the heating unit, in particular by a size of the heating unit and/or by a shape of the heating unit, which supplies energy to the heating zone in the heating operating state. In particular the heating zone, in particular a size of the heating zone and/or a shape of the heating zone, is at least substantially independent of a cooking container placed thereon, in particular of a size of a cooking container placed thereon and/or of a shape of a cooking container placed thereon. For example, the heating region which could comprise, in particular, a combined heating zone could be defined by at least two heating units and, in particular, form a variable cooking surface. The heating units could in this case be arranged, in particular, in a row and/or in the shape of a hob matrix. Alternatively, the heating region, which in particular could comprise a combined heating zone, could be defined by at least two individual heating units. "Individual" heating unit is intended to be understood, in particular, as a heating unit which is at a distance of at least 1 cm, in particular at least 2 cm, advantageously at least 3 cm, particularly advantageously at least 4 cm and preferably at least 5 cm from a heating unit adjacent to the heating unit, in particular the next adjacent heating unit. In particular, a hob which comprises the individual heating unit is configured as a conventional hob. "Conventional" hob is intended to be understood, in particular, as a hob with at least one individual heating unit on which the individual heating unit is visually distinguished, in particular identified, for example by screen printing and/or by the display unit and/or by at least one display element of the display unit, such as for example an LED. In particular, a conventional hob differs from a matrix hob. A matrix hob differs, in particular, from a conventional hob by a variable cooking surface. As a result, in particular, cooking containers of different sizes may be warmed and/or heated by means of the heating region.

Additionally, it is proposed that in the operating mode the control unit is provided to identify at least partially an edge of the heating region by means of the identification. For example, in the operating mode the control unit could be provided to identify an edge of the heating region, at least substantially fully by means of the identification. In the operating mode, the control unit is provided, in particular, to identify at least partially the heating region by means of the identification. In particular, in the operating mode the control unit is provided to identify by means of the identification the corner points of the heating region and, in particular, to identify at least partially and/or to leave at least partially unidentified the shortest connections between the corner points. In particular, in the operating mode the control unit is provided to leave unidentified the shortest connections between the corner points to a proportion of at least 30%, in particular at least 40%, advantageously at least 50%, particularly advantageously at least 60% and preferably at least 70% of a longitudinal extension of the shortest connections between the corner points. When observing a projection in a plane which, in particular, is oriented parallel to a main extension plane of the hob plate, the edge of the heating region, in particular, is a periphery of the heating region. As a result, an optimal identification of the heating region may be possible, in particular at low cost. Low costs may be achieved, in particular, by one possibility of arranging at least one part of the display unit, such as for example at least one display element, in particular an LED, in a region between at least two heating units defining the heating region.

It is further proposed that in the operating mode the control unit is provided to identify at least one position of individual heating units defining the heating region by means of the identification. For example, the control unit could be provided, in particular in addition to an identification of the edge of the heating region, to identify the position of the heating units defining the heating region by an identification of an edge of the heating units defining the heating region. Alternatively or additionally, the control unit could be provided to identify at least one position of a point of gravity and/or a central point of the heating units defining the heating region by means of the identification. As a result, cooking containers may be placed specifically on suitable heating units, in particular depending on a size of individual heating units defining the heating region, whereby a heating zone which is suitable for heating a given cooking container may be optimally selected in a simple manner.

It is further proposed that in the operating mode the control unit is provided to display at least one temperature of a heating zone of the heating region which is activated and/or deactivated by means of the identification, in particular by means of the identifying property. The temperature of the heating zone is, in particular, a temperature of a surface of the heating region which is arranged in the region of the heating zone and which, in particular, is formed by a surface of the hob plate. For example, in the operating mode the control unit, in particular, could be additionally provided to display at least a residual heat of an, in particular, deactivated heating zone of the heating region by means of the identification, in particular by means of the identifying property. In particular, in the operating mode the control unit could be provided to reduce an intensity of the identification monotonously, in particular in a linear manner, in the case of a reducing temperature. In particular, a temperature of a deactivated heating zone reduces with an increased chronological distance between the deactivation of the deactivated heating zone and a time of the display of the temperature of the deactivated heating zone. As a result, in particular, a high level of safety is ensured and/or a warning may be transmitted to an operator in a simple and/or intuitive manner.

A particularly high degree of convenience may be achieved by a hob, in particular by an induction hob, having at least one hob apparatus according to the invention.

The convenience may be further increased by a method comprising a hob apparatus according to the invention, in particular comprising an induction hob apparatus according to the invention, having at least one heating region on which at least one cooking container can be placed for heating purposes, and comprising a dynamic display unit which is provided in at least one operating mode for identifying the heating region. In the operating mode at least one identifying property of the identification of the heating region is selected depending on at least one operating parameter.

The hob apparatus is not intended to be limited here to the above-described use and embodiment. In particular, for fulfilling a mode of operation described herein the hob apparatus may have a number of individual elements, components and units which is different from a number cited herein.

Further advantages are disclosed in the following description of the drawings. In the drawings, exemplary embodiments of the invention are shown. The drawings, the description and the claims contain numerous features in combination. The person skilled in the art will also expediently consider the features individually and combine them to create further useful combinations.

DETAILED DESCRIPTION OF EXEMPLARY EMBODIMENTS OF THE PRESENT INVENTION

Figure 1:
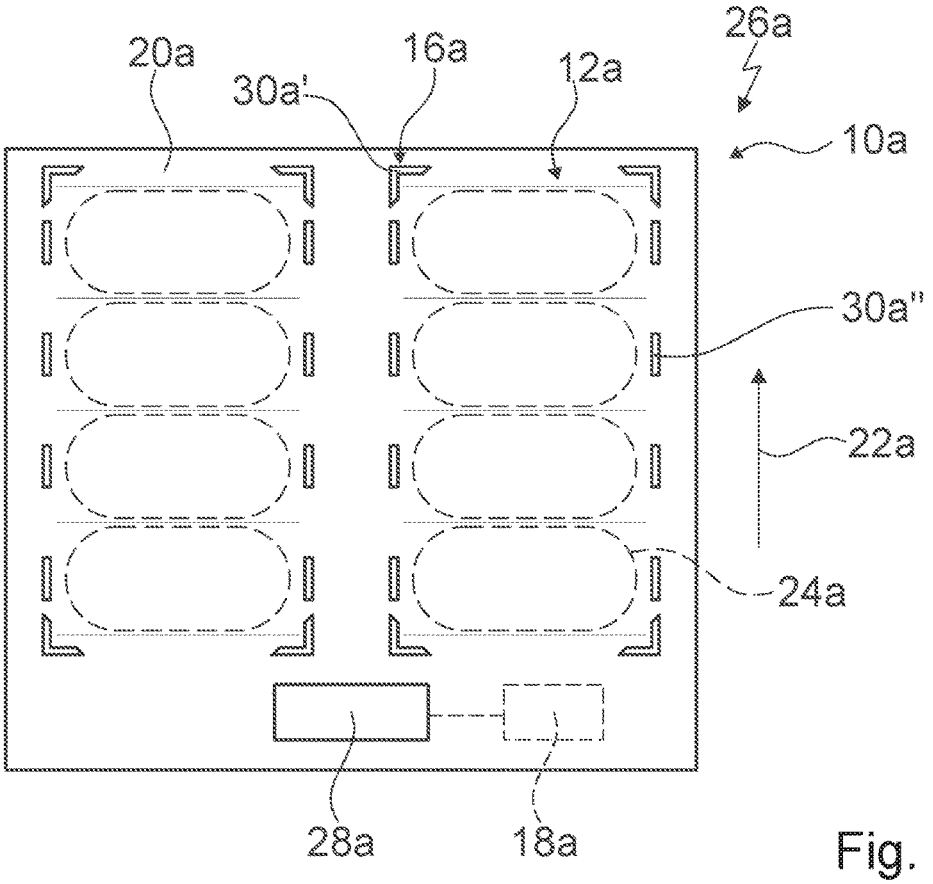
FIG. 1 shows a hob with a hob apparatus out of an operating mode in a schematic plan view.

FIG. 1 shows a hob 26*a* which is configured as an induction hob, with a hob apparatus 10*a* which is configured as an induction hob apparatus. The hob apparatus 10*a* has a hob plate 20*a*. In a mounted state the hob plate 20*a* forms part of an external housing of the hob. The hob plate 20*a* is provided for placing a cooking container 14*a* thereon.

The hob apparatus 10*a* has a plurality of heating units 24*a*. In the figures, of objects which are repeatedly present, in each case only one is provided with a reference numeral. The heating units 24*a* define a variable cooking surface region. In each case four of the heating units 24*a* are arranged in a row. Alternatively, the hob apparatus could have a plurality of heating units which could be arranged in the form of a matrix.

In the present exemplary embodiment, the hob apparatus 10*a* comprises eight heating units 24*a*. The heating units 24*a* are provided to heat a cooking container 14*a* placed on the hob plate 20*a* above the heating units 24*a*. The heating units 24*a* are configured as induction heating units.

The hob apparatus 10*a* has an operator interface 28*a* for the input and/or selection of operating parameters, for example a heat output and/or a heat output density and/or a heating zone. The operator interface 28*a* is provided for the output of a value of an operating parameter to an operator.

The hob apparatus 10*a* has a control unit 18*a*. The control unit 18*a* is provided to carry out actions and/or to alter settings depending on operating parameters which are input via the operator interface 28*a*. In a heating operating state the control unit 18*a* regulates an energy supply to the heating units 24*a*.

In the present exemplary embodiment, the hob apparatus 10*a* comprises two heating regions 12*a*. The heating regions 12*a* are arranged adjacent to one another relative to a transverse direction. Of the heating regions 12*a*, only one is described hereinafter. In the present exemplary embodiment, the heating region 12*a* is defined by four heating units 24*a*.

The heating region 12*a* extends from a region facing an operator into a region remote from an operator. A cooking container 14*a* is able to be placed on the heating region 12*a* for heating.

The hob apparatus 10*a* has a dynamic display unit 16*a*. The display unit 16*a* is provided in an operating mode for identification of the heating region 12*a*. The identification is a light. In the operating mode, the display unit 16*a* is provided for illuminating the heating region 12*a*.

The display unit 16*a* has at least one display element 30*a*. In the present exemplary embodiment, the display unit 16*a* comprises a plurality of display elements 30*a*. Of the display elements 30*a*, only one is described hereinafter. The display element 30*a* is an LED.

For example, an operator activates the operating mode by an operating input via the operator interface 28*a*. In the operating mode, the control unit 18*a* selects an identifying property of the identification of the heating region 12*a* depending on an operating parameter.

A size of the heating region 12*a* in the operating mode is substantially constant. In the operating mode, the control unit 18*a* keeps a size of the identification of the heating region 12*a* substantially constant.

Figure 2:
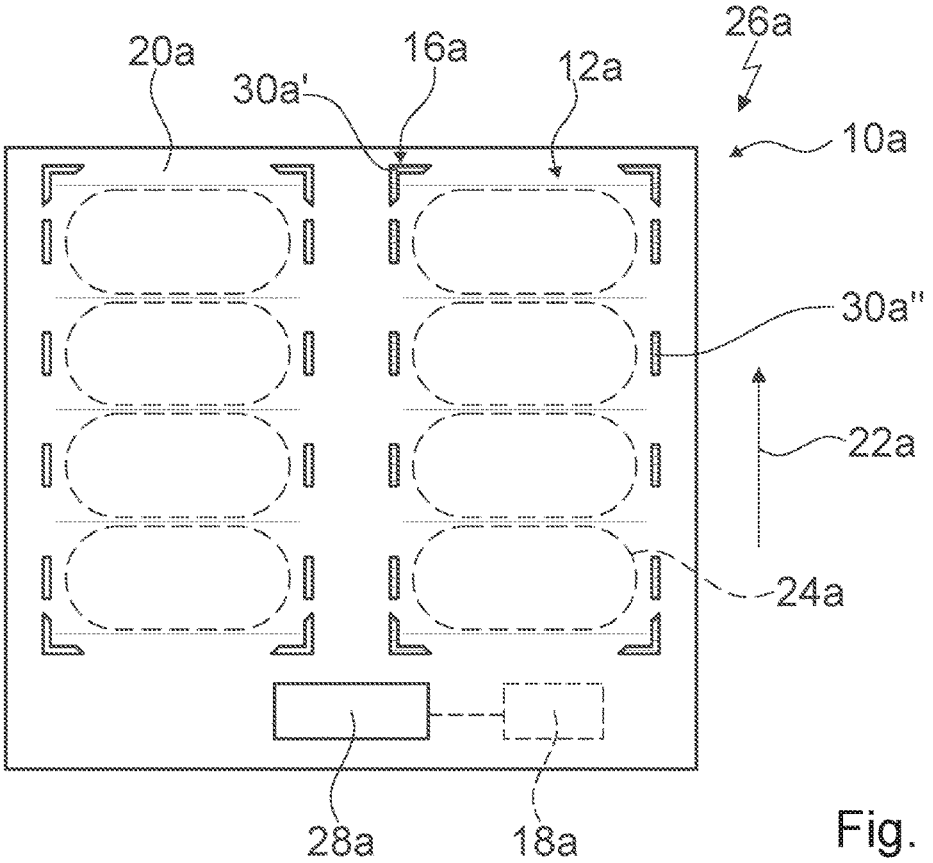
FIG. 2 shows the hob with the hob apparatus in an operating mode before the start of a heating operating state in a schematic plan view.

In the case of an activation of the operating mode the control unit 18*a* identifies the heating region 12*a* by means of the identification provided by the display unit 16*a*. In the operating mode, the control unit 18*a* alters the identifying property depending on an alteration of the operating parameter. In the present exemplary embodiment the identifying property is an intensity of the identification of the heating region 12*a*. In the case of an activation of the operating mode, the control unit 18*a* identifies the heating region 12*a* until the start of a heating operating state in which, in particular, at least one cooking container 14*a* placed on the heating region 12*a* is heated with a lower intensity of the operating parameter (see FIG. 2).

Alternatively, the control unit could be provided to identify each heating region with a low intensity of the operating parameter and, in particular with an activation of the operating mode in one of these heating regions, to identify this heating region with a greater intensity of the operating parameter.

In the present exemplary embodiment, the operating mode is an operating mode denoted as "power move". Alternatively, the operating mode could be an operating mode denoted as "temperature move".

In the operating mode, the control unit 18*a* assigns a predefined heating parameter to every heating unit 24*a*. In the operating mode, the control unit 18*a* assigns a greater value of the heating parameter to a heating unit 24*a* arranged in the region facing an operator than to a heating unit 24*a* arranged in the region facing away from an operator.

In the present exemplary embodiment, the control unit 18*a* selects the identifying property of the identification of the heating region 12*a* depending on the heating parameter. In the operating mode, the operating parameter is a heating parameter.

In the operating mode, the control unit 18*a* displays an operating parameter which alters in a direction 22*a* oriented parallel to the hob plate 20*a* by means of the identification of the heating region 12*a*. The direction 22*a* faces from the region facing an operator into the region facing away from an operator. The direction 22*a* is a depth direction. In the present exemplary embodiment, the operating parameter in the direction 22*a* decreases monotonously.

Figure 3:
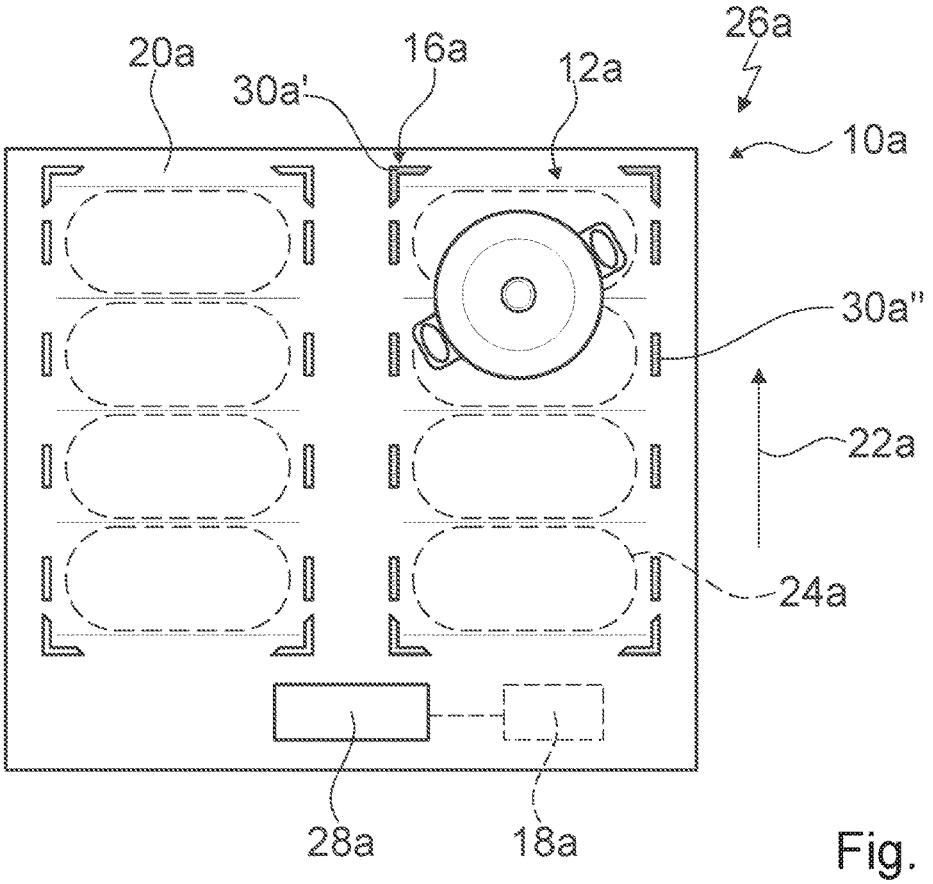
FIG. 3 shows the hob with the hob apparatus in an operating mode before the heating operating state in a schematic plan view.

When a cooking container 14*a* is placed on the heating region 12*a* the control unit 18*a* starts the heating operating state. In the heating operating state the control unit 18*a* regulates a heating of the cooking container 14*a*. In the heating operating state, the control unit 18*a* regulates an energy supply to the heating units 24*a* above which the cooking container 14*a* is placed. In the heating operating state, the control unit 18*a* identifies the heating region 12*a* with a high intensity of the operating parameter (see FIG. 3).

The heating units 24*a* heating the cooking container 14*a* define a heating zone (not shown). In the operating mode, the control unit 18*a* displays a temperature of an activated heating zone of the heating region 12*a* by means of the identification. For example, the control unit could display a high temperature of the heating zone of the heating region with a first color, such as in particular red, and a low temperature of the heating zone of the heating region with a second color which is different from the first color, such as in particular blue, by means of the identification. The identifying property could, for example, be a color of the identification of the heating region. Alternatively or additionally, the control unit could display different temperatures by means of different intensities. In this case the identifying property, for example, could be an intensity of the identification of the heating region.

In the present exemplary embodiment, the heating zone of the heating region 12*a* is defined by two heating units 24*a*. The heating zone is a combined heating zone. The heating region 12*a* comprises the combined heating zone. The combined heating zone is part of the heating region 12*a*. In the heating operating mode, the heating zone defines an activated partial region of the heating region 12*a*.

In the operating mode, the control unit 18*a* identifies the activated partial region of the heating region 12*a* and a deactivated part of the heating region 12*a*. In the operating mode, the control unit 18*a* identifies the entire heating region 12*a*. In the operating mode, the control unit 18*a* partially identifies an edge of the heating region 12*a*.

Figure 5:
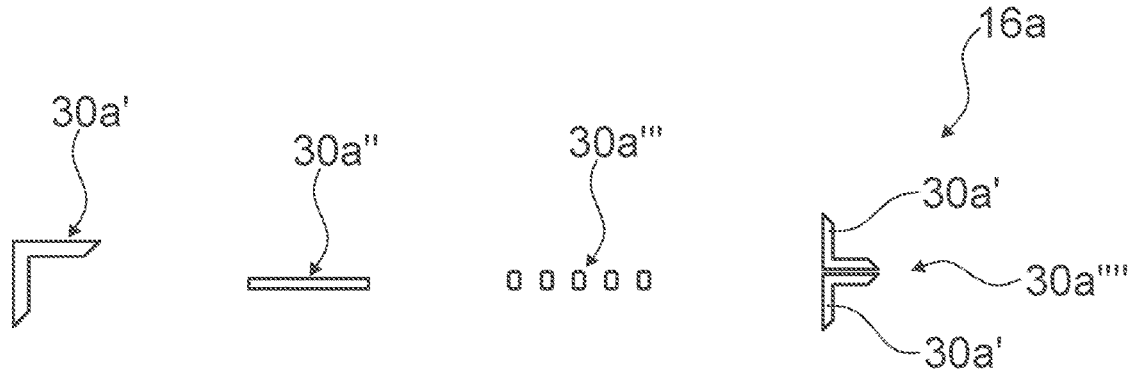
FIG. 5 shows different display elements of a display unit of the hob apparatus in a schematic view.

The display unit 16*a* is arranged in the immediate vicinity of the heating units 24*a*. The display unit 16*a* partially surrounds the heating region 12*a*. A display element 30*a* is arranged at specific points of the edge of the heating region 12*a* in each case. The display unit 16*a* has display elements 30*a* of different geometry (see FIG. 5).

The display unit 16*a* has a first display element 30*a*'. The first display element 30*a*' is substantially L-shaped and/or hook-shaped and/or boomerang-shaped. The first display element 30*a*' is provided for identification of a corner of the heating region 12*a*. The first display element 30*a*' is provided for identification of a boundary of the heating region 12*a*.

Alternatively, the first display element could be provided for identification of a boundary of a heating unit.

The display unit 16*a* has a second display element 30*a*". The second display element 30*a*" has an elongated, substantially rectangular shape. The second display element 30*a*" is provided for identification of an elongated lateral edge of the heating region 12*a*. In the present exemplary embodiment, the second display element 30*a*" has a substantially continuous elongated shape which is substantially rectangular.

The display unit 16*a* has a third display element 30*a*'". The third display element 30*a*'" has a plurality of substantially square shapes which are arranged in a row. The third display element 30*a*'" has a substantially elongated shape which is defined by the plurality of substantially square shapes. The third display element 30*a*'" is provided for identifying an elongated lateral edge of the heating region 12*a*.

The display unit 16*a* has a fourth display element 30*a*"". The fourth display element 30*a*"" is defined by two first display elements 30*a*' which adjoin one another along one respective edge of the shapes of the first display elements 30*a*'. The first display elements 30*a*' defining the fourth display element 30*a*"" are arranged substantially mirror-symmetrically.

In the present exemplary embodiment, the identification of the heating region 12*a* has four first display elements 30*a*' and eight second display elements 30*a*". The first display elements 30*a*' are provided for an identification of the corners of the heating region 12*a*. A longitudinal direction of one respective second display element 30*a*" is oriented substantially parallel to the direction 22*a*. The direction 22*a* is arranged parallel to a longitudinal direction of extension of the heating region 12*a*. The second display elements 30*a*" are arranged on opposing sides of the heating region 12*a* relative to the transverse direction. The second display elements 30*a*" are arranged so as to be distributed substantially uniformly between two immediately adjacent first display elements 30*a*' relative to the direction 22*a*.

The second display elements 30*a*" are arranged substantially level with the center of gravity and/or central point of the heating units 24*a*. In the operating mode, the control unit 18*a* identifies a position of the individual heating units 24*a* defining the heating region 12*a* by means of the identification.

Figure 4:
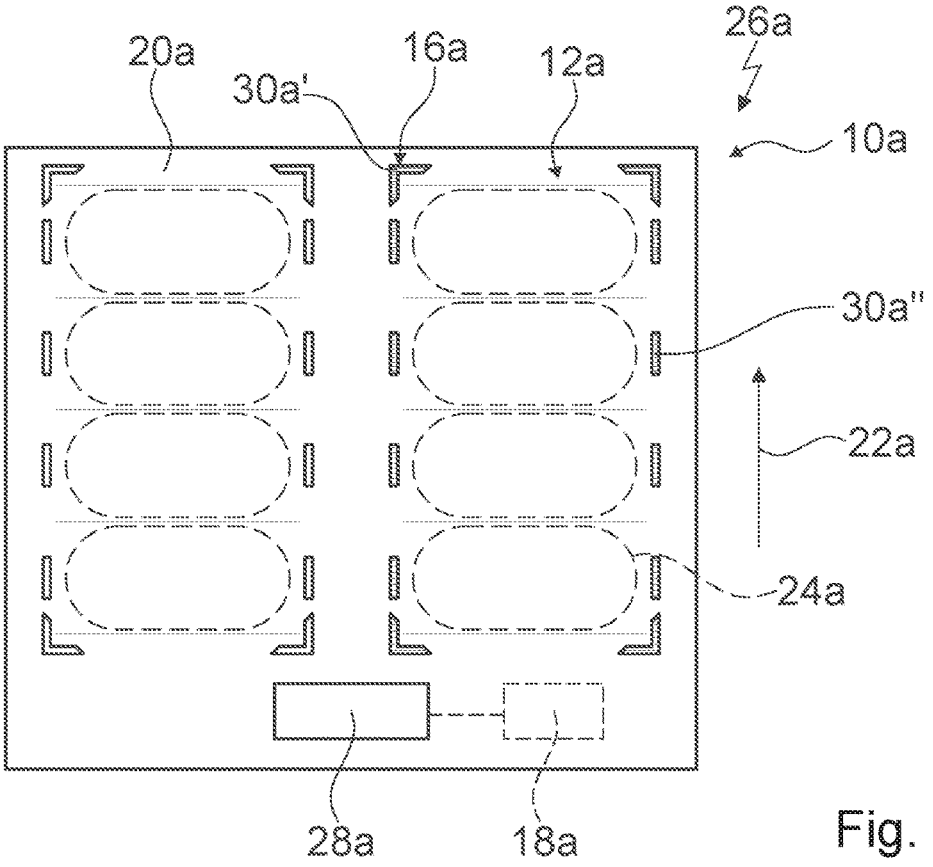
FIG. 4 shows the hob with the hob apparatus in an operating mode before the end of the heating operating state in a schematic plan view.

When the cooking container 14*a* is removed from the heating region 12*a* the control unit 18*a* terminates the heating operating state (see FIG. 4). The control unit 18*a* stops an energy supply to the heating units 24*a* defining the heating zone. When the heating operating state is terminated, the activated heating zone becomes a deactivated heating zone.

Immediately after terminating the heating operating state, the deactivated heating zone has a slightly lower temperature than the activated heating zone shortly before terminating the heating operating state. In the operating mode, the control unit 18*a* displays a temperature of a deactivated heating zone of the heating region 12*a* by means of the identification.

In a method comprising the hob apparatus 10*a*, the heating region 12*a* is identified by means of the identification of the heating region 12*a*. In the method, an identifying property of the identification of the heating region 12*a* is selected in the operating mode depending on an operating parameter.

Figure 6:
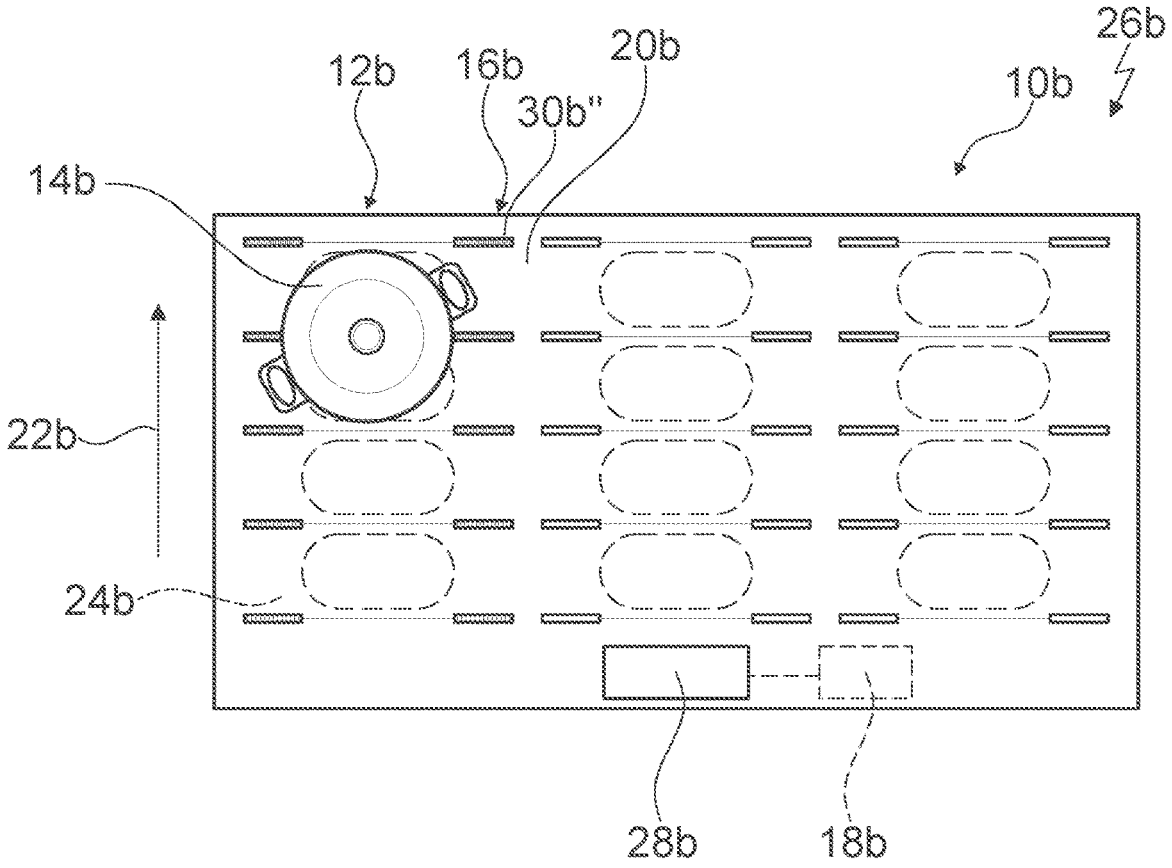
FIG. 6 shows a hob with an alternative hob apparatus in an operating mode in a schematic plan view and FIG. 7 shows a hob with an alternative hob apparatus in an operating mode in a schematic plan view.
Figure 7:
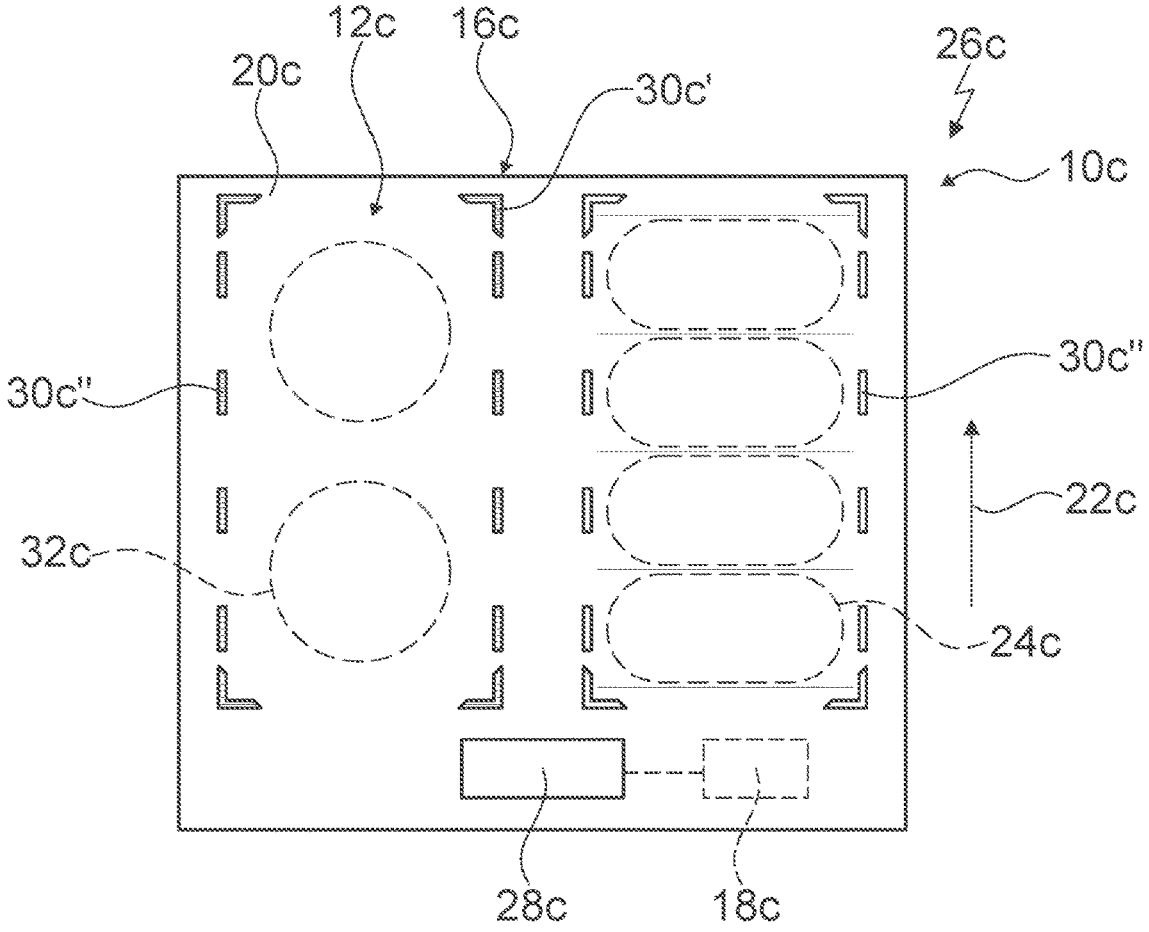

In FIGS. 6 and 7 two further exemplary embodiments of the invention are shown. The following descriptions are substantially limited to the differences between the exemplary embodiments, wherein relative to components, features and functions which remain the same, reference may be made to the description of the exemplary embodiment of FIGS. 1 to 5. For differentiating the exemplary embodiments, the letter a in the reference numerals of the exemplary embodiment in FIGS. 1 to 5 is replaced by the letters b and c in the reference numerals of the exemplary embodiment of FIGS. 6 and 7. Relative to components which are denoted the same, in particular relative to components with the same reference numeral, in principle reference may also be made to the drawings and/or the description of the exemplary embodiment of FIGS. 1 to 5.

FIG. 6 shows a hob 26*b* with an alternative hob apparatus 10*b*. In the present exemplary embodiment the hob apparatus 10*b* has twelve heating units 24*b*. A dynamic display unit 16*b* of the hob apparatus 10*b* is provided in an operating mode for identification of a heating region 12*b* of the hob apparatus 10*b*. In the operating mode, the control unit 18*b* selects an identifying property of the identification of the heating region 12*b* depending on an operating parameter.

In the operating mode, the control unit 18*b* identifies a position of individual heating units 24*b* defining the heating region 12*b* by means of the identification. In the operating mode, the control unit 18*b* identifies the intermediate spaces between immediately adjacent heating units 24*b*. In the operating mode, the control unit 18*b* partially identifies an edge of the heating region 12*b* by means of the identification. In the operating mode, the control unit 18*b* identifies the upper and/or lower and/or lateral edges of the heating units 24*b* on the edge, in particular relative to a direction 22*b*, which is a depth direction.

In the operating mode, the control unit 18*b* identifies each heating unit 24*b* by means of four display elements 30*b* of the display unit 16*b*. In the operating mode, the control unit 18*b* partially assigns the same display elements 30*b* to the immediately adjacent heating units 24*b*. Display elements 30*b*, which identify an intermediate space between two immediately adjacent heating units 24*b*, are assigned equally to both heating units 24*b*.

In the present exemplary embodiment, the identification of the heating region 12*b* has ten second display elements 30*b*". A longitudinal direction of extension of one respective second display element 30*b*" is oriented substantially perpendicular to the direction 22*b*. In each case, five second display elements 30*b*" are arranged one behind the other in the direction 22*b*. In each case, two second display elements 30*b*" are arranged on opposing sides of the heating region 12*b* relative to a transverse direction. The transverse direction is oriented perpendicular to the direction 22*b*.

FIG. 7 shows a hob 26*c* with an alternative hob apparatus 10*c*. In the present exemplary embodiment, the hob apparatus 10*c* has four heating units 24*c* which define a variable cooking surface region. The hob apparatus 10*c* has two individual heating units 32*c*. The individual heating units 32*c* define a heating region 12*c* of the hob apparatus 10*c*.

Alternatively, the hob apparatus could have two heating units which together could define a combined heating zone. For example, the heating units could be arranged concentrically to one another. Alternatively or additionally, the heating units could adjoin one another directly. In this case, for example, a first of the heating units could be substantially circular shaped and a second of the heating units could be substantially sickle-shaped. The second heating unit could at least partially encompass the first heating unit.

A dynamic display unit 16*c* of the hob apparatus 10*c* is provided in an operating mode for identification of the heating region 12*c*. In the operating mode, the control unit 18*c* selects an identifying property of the identification of the heating region 12*c* depending on an operating parameter.

The invention claimed is:

1. A hob apparatus, comprising:

a heating region for placement and heating of a cooking container;

a dynamic display unit configured to provide an identification of the heating region in an operating mode of the hob apparatus; and a control unit configured to:

control activation of the dynamic display unit to provide the identification of the heating region in response to an activation of the operating mode while being independent of placing and removing the cooking container in and out of the heating region and independent of carrying out a heating process, select an identifying property of the identification of the heating region in the operating mode, depending on an operating parameter of the hob apparatus, and control an illumination of the dynamic display unit to provide the selected identifying property of the identification of the heating region.

2. The hob apparatus of claim 1, wherein the control unit is configured to control the dynamic display unit to keep, in the operating mode, a variable of the identification substantially constant.

3. The hob apparatus of claim 1, wherein the control unit is configured to control the dynamic display unit to alter, in the operating mode, the identifying property in response to an alteration of the operating parameter.

4. The hob apparatus of claim 1, wherein the identifying property is an intensity of the identification of the heating region.

5. The hob apparatus of claim 1, further comprising a hob plate, said control unit being configured to control the dynamic display unit to display, in the operating mode, an alteration of the operating parameter in a direction oriented parallel to the hob plate by means of the identification of the heating region.

6. The hob apparatus of claim 5, wherein the direction is a depth direction.

7. The hob apparatus of claim 1, wherein the operating parameter is a heating parameter.

8. The hob apparatus of claim 1, wherein the heating region comprises at least one combined heating zone including a plurality of heating units.

9. The hob apparatus of claim 1, wherein the heating region comprises a plurality of heating units, and wherein the control unit is configured to control the dynamic display unit to identify, in the operating mode, at least partially an edge of the heating region by means of the identification.

10. The hob apparatus of claim 1, wherein the heating region comprises a plurality of heating units, and wherein the control unit is configured to control the dynamic display unit to identify, in the operating mode, at least one position of individual ones of the heating units by means of the identification.

11. The hob apparatus of claim 1, wherein the control unit is configured to control the dynamic display unit to display, in the operating mode, an illumination representing a temperature of a heating zone of the heating region by means of the identification.

12. A hob, comprising a hob apparatus, said hob apparatus comprising a heating region for placement and heating of a cooking container, a dynamic display unit configured to provide an identification of the heating region in an operating mode of the hob apparatus, and a control unit configured to:

control activation of the dynamic display unit to provide the identification of the heating region in response to an activation of the operating mode while being independent of placing and removing the cooking container in and out of the heating region and independent of carrying out a heating process, select an identifying property of the identification of the heating region in the operating mode, depending on an operating parameter of the hob apparatus, and control an illumination of the dynamic display unit to provide the selected identifying property of the identification of the heating region.

13. The hob of claim 12, constructed in the form of an induction hob.

14. A method of operating a hob apparatus, comprising:

identifying, by a control unit configured to control activation of a dynamic display unit, an identification of a heating region on which a cooking container is placeable for heating purposes, in response to an activation of an operating mode by the hob apparatus while being independent of placing and removing the cooking container in and out of the heating region and independent of carrying out a heating process;

selecting, by the control unit, an identifying property of the identification of the heating region depending on an operating parameter of the hob apparatus, and controlling, by the control unit, an illumination of the dynamic display unit to provide the selected identifying property of the identification of the heating region.

15. The method of claim 14, further comprising keeping, by the control unit controlling the illumination of the dynamic display unit in the operating mode, a variable of the identification substantially constant.

16. The method of claim 14, further comprising altering, by the control unit controlling the illumination of the dynamic display unit in the operating mode, the identifying property in response to an alteration of the operating parameter.

17. The method of claim 14, wherein the identifying property is an intensity of the identification of the heating region.

18. The method of claim 14, further comprising displaying, by the control unit controlling the illumination of the dynamic display unit in the operating mode, an alteration of the operating parameter in a direction oriented parallel to a hob plate of the hob apparatus by means of the identification of the heating region.

19. The method of claim 18, wherein the direction is a depth direction.

20. The method of claim 14, wherein the operating parameter is a heating parameter.

21. The method of claim 14, further comprising identifying, by the control unit controlling the illumination of the dynamic display unit in the operating mode, at least partially an edge of the heating region by means of the identification.

22. The method of claim 14, further identifying, by the control unit controlling the illumination of the dynamic display unit in the operating mode, at least one position of individual heating units defining the heating region by means of the identification.

23. The method of claim 14, further comprising displaying, by the control unit controlling the dynamic display unit in the operating mode, an illumination representing a temperature of a heating zone of the heating region by means of the identification.

* * * * *